US005832964A

United States Patent [19]

Joshi

[11] Patent Number: 5,832,964

[45] Date of Patent: Nov. 10, 1998

[54] CABLE TIE TENSIONING AND SEVERING TOOL

[75] Inventor: Anurag B. Joshi, Hanover Park, Ill.

[73] Assignee: Pandiut Corp., Tinley Park, Ill.

[21] Appl. No.: 957,080

[22] Filed: Oct. 24, 1997

[51] Int. Cl.[6] ..... B21F 9/02

[52] U.S. Cl. ..... 140/123.6

[58] Field of Search ..... 140/152, 139, 140/123.6, 93.2, 93 A; 83/568, 582; 30/282

[56] References Cited

U.S. PATENT DOCUMENTS 3,661,187 5/1972 Caveney et al. .
3,830,263 8/1974 Benfer .
4,765,707 8/1988 Margolin .
5,065,798 11/1991 Alletto et al. .
5,069,053 12/1991 Wallis ..... 72/185

*Primary Examiner*—Lowell A. Larson
*Attorney, Agent, or Firm*—Mark D. Hilliard; Robert A. McCann; Michael J. Turgeon

[57] ABSTRACT

A cable tie application tool having a severance blade positioned between a blade guard and a boss, and a biasing mechanism extending from a bore in the boss, wherein the biasing mechanism forces the severance blade to remain in planar contact with the blade guard during vertical movement thereof, and wherein a cable tie strap may subsequently be severed flush with a cable tie head resulting in a snug-free installation.

12 Claims, 4 Drawing Sheets

CABLE TIE TENSIONING AND SEVERING TOOL

TECHNICAL FIELD

The present invention relates generally to hand tools having a mechanism to withdraw the strap of a cable tie away from the head of the cable tie to tension the cable tie around an object and to sever the strap adjacent the head of the cable tie when a predetermined tension is reached in the cable tie. More specifically, the present invention relates to a cable tie tensioning and severing tool that is specially designed to reliably and repeatedly sever the straps of cable ties flush with the head of the cable tie.

BACKGROUND OF THE INVENTION

Prior tools of a design similar to the present invention are illustrated by U.S. Pat. Nos. 3,661,187 and 3,830,263. These tools were designed for the application of molded nylon cable ties without regard to varying production tolerances of the housing, blade and blade guard, the interaction and build-up of the tolerances, and the imprecise fit therewith. A result of this disregard is the sizable cut-off height, wherein a portion of the cable strap protrudes from the cable tie head resulting in sharp edges which may injure or snag on persons or objects during installation or servicing. In other words, these prior tools were not designed to provide optimum operation, merely basic operation.

The tool of U.S. Pat. Nos. 3,661,187 severed the strap of a cable tie by selectively pivoting a linkage to force a blade through the thickness of the tie strap and just prior to the complete severance of the straps releasing the force applied to the blade to withdraw the blade. The blade of the tool notches the strap allowing the relatively soft strap to yield under the tensioning force applied by the tool to completely sever the strap.

The tool of U.S. Pat. No. 3,830,263 severs the strap of a cable tie by selectively driving a cutting blade through the strap of a cable tie against an anvil.

In each of these prior designs, the severance blade is loosely retained in a retracted position in an area defined by the housing, blade guard, boss and lever arm. Production tolerances on each of these parts can vary considerably as a result of cost containment. Tightening the tolerances on all of the parts to more tightly retain the severance blade could decrease cut-off height, however increases in the associated costs of production and sale make this option unfeasible. Attention to these tolerances is very important, as the cut-off height performance of the tool is directly related thereto in prior art tools.

Cut-off height is often one of the most critical factors regarding cable tie installation. The small portion of cable tie strap which protrudes from the cable tie head usually has sharp edges which may injure or the protruding portion may snag on persons or objects during installation or servicing. All of these disadvantages are sharply criticized by consumers. The prior art tools are unable to produce a flush cut-off height by design.

As shown in FIGS. 1–3 in the prior art tool, the severance blade in the retracted position lies flush against the blade guard. However, notice that there is a certain clearance space between the severance blade and the housing boss, as a result of generally loose production tolerances. The lever arm, which is operatively connected to the severance blade, pivots to actuate the severance blade in an upward motion when the desired preselected tension force is achieved. Since the lever arm pivots, the severance blade travels along the arc of the actuation linkage and is tipped towards the housing boss. As a result of the clearance space between the boss and the blade guard, the cut-off height is increased as the severance blade tips away from the blade guard. An angle cut on the cable tie straps results from the blade being disposed at an angle to vertical. Furthermore, during the tensioning and just prior to cut-off when the blade first contacts the strap, the cable strap slightly pulls the severance blade towards the boss, subsequently increasing cut-off height.

A possible solution forwarded has been to tighten the production tolerances of the interacting parts. However, this is economically unfeasible for such an inexpensive tool. A commercially desirable cable tie tool must be able to tension and cleanly sever cable tie straps flush with a cable tie head. The use of prior tools to provide a flush cut-off height has not proven satisfactory. The use of a tool produced with loose production manufacturing tolerances on many of the vital parts which results in cable tie strap protruding from the cable tie head is unacceptable.

Therefore, in the design of cable tie application tools, an inexpensive, consistent and reliable manner of applying flush cut-off height cable ties is needed.

SUMMARY OF THE INVENTION

It is, therefore, an object of the present invention to provide an improved cable tie application tool.

It is a further object of the present invention to provide an inexpensive cable tie application tool which consistently and reliably provides a cable tie strap flush cut-off height.

In general, a cable tie application tool includes a means for positioning a severance blade between a boss and a blade guard; and means for biasing the severance blade extending from a bore in the boss, wherein the biasing means forces the severance blade to remain in planar contact with the blade guard during vertical movement thereof; and wherein a cable tie strap may subsequently be severed flush with a cable tie head resulting in a snag-free installation.

DESCRIPTION OF THE PREFERRED EMBODIMENT

A cable tie tensioning and severing tool embodying the concept of the present invention is designated generally by the numeral 10 in the accompanying drawings. The actuation mechanism for tensioning and severing the cable tie strap is only partially shown in FIGS. 4–9, the details of its operation being explained in detail in U.S. Pat. No. 3,661,187 to Caveney et al. which is incorporated herein by reference.

Figure 1:
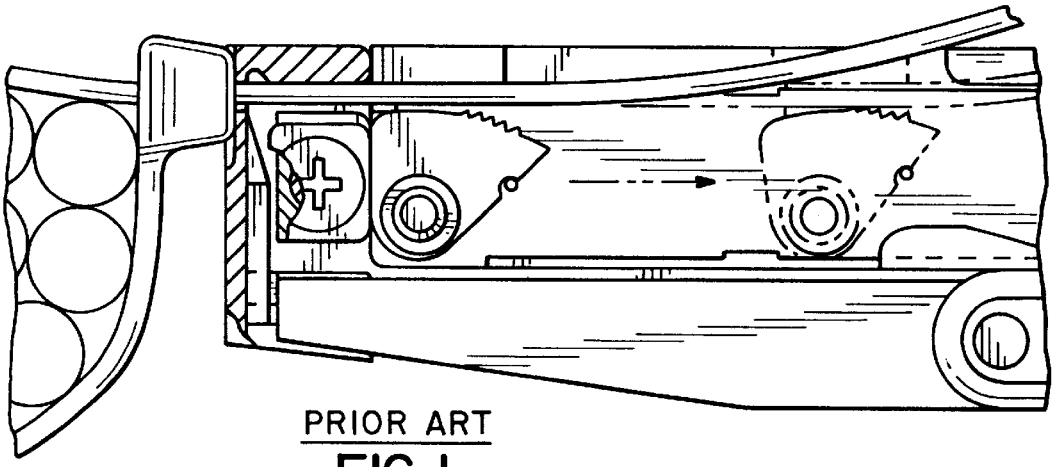
PRIOR ART FIG. 1
FIG. 1 is a fragmentary sectional view of the nose of a prior art cable tie tensioning and severing tool before actuation of the severance blade.
Figure 2:
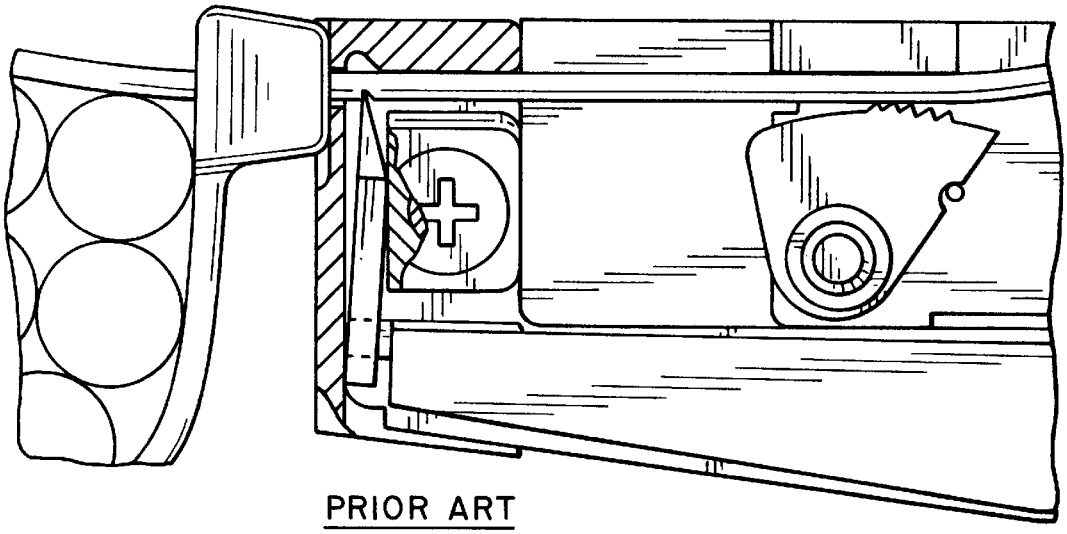
PRIOR ART FIG. 2
FIG. 2 is a fragmentary sectional view of the prior art tool of FIG. 1 showing the severance blade pitched at an angle to the blade guard after actuation by the lever arm.
Figure 3:
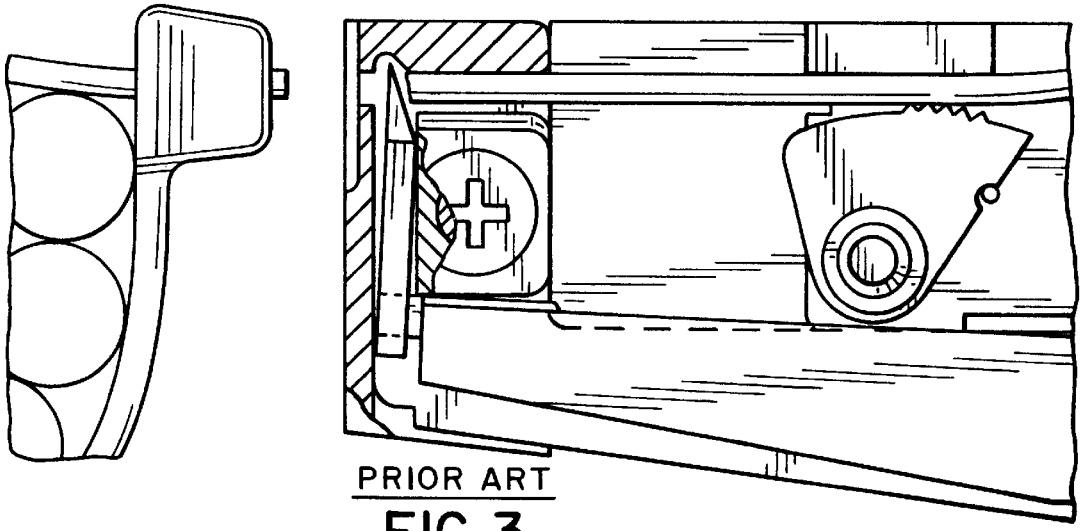
PRIOR ART FIG. 3
FIG. 3 is a fragmentary sectional view of the prior art tool of FIG. 1 showing the protruding cut-off height which is a result of uncontrolled blade movement.
Figure 4:
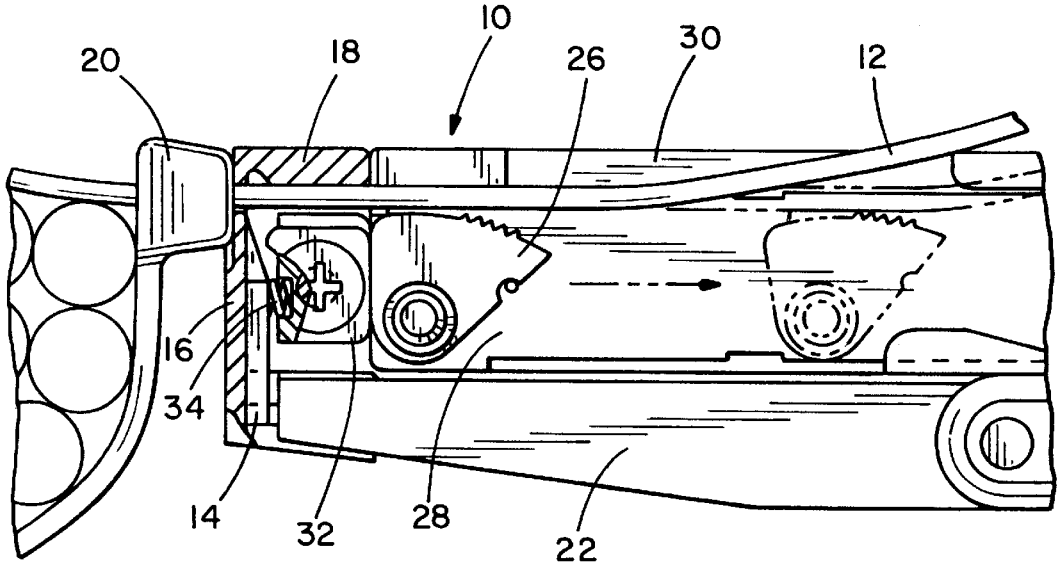
FIG. 4 is a fragmentary sectional view of a cable tie tensioning and severing tool embodying the concept of the present invention showing the tool mechanism before actuation of the severance blade.
Figure 5:
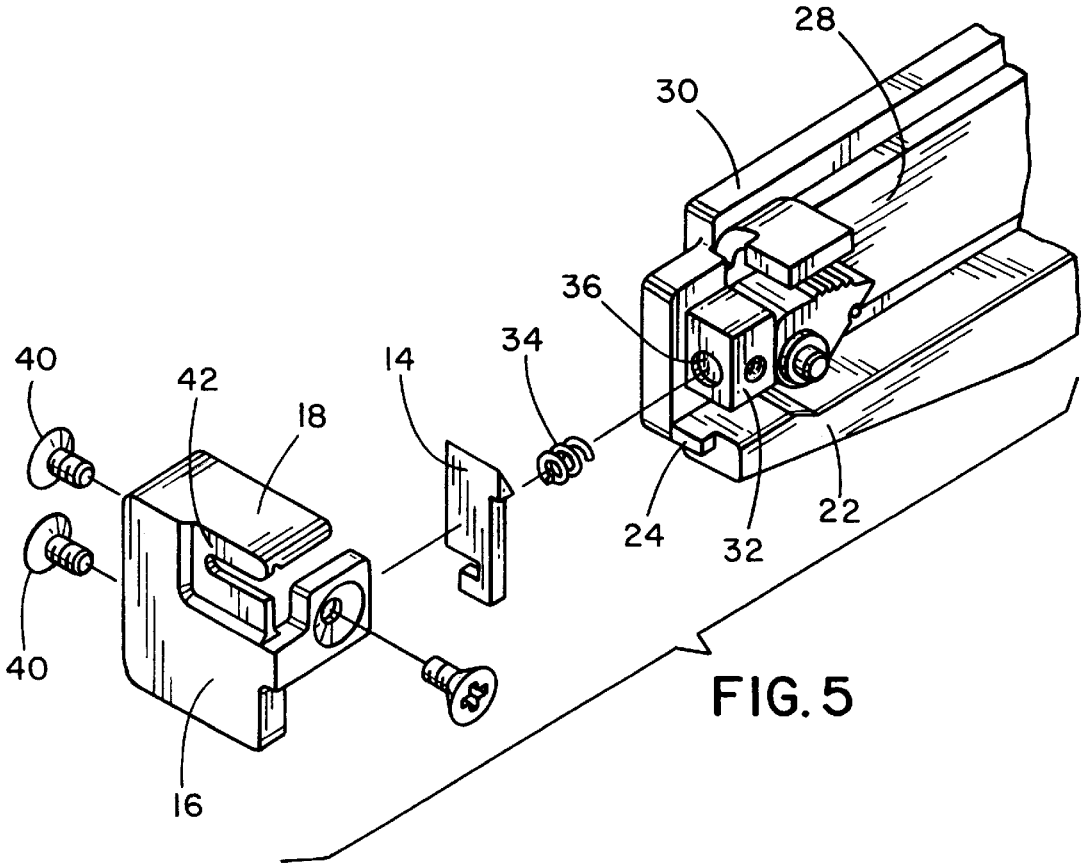
FIG. 5 is an exploded perspective view of the tool of FIG. 4.

As seen in FIG. 4, strap 12 of a cable tie is positioned in tool 10 horizontally, between a severance blade 14 and a horizontal portion 18 of the blade guard 16, with the head 20 of the cable tie abutting a recessed portion of the blade guard 16 which enhances a reduced cut-off height. A pivotal blade actuation linkage 22, the distal end of which is operatively connected to blade 14, is disposed to selectively pivot between a strap insertion position shown in FIG. 4 and a strap severance position shown in FIG. 7. A gripper pawl 26 is pivotally mounted at the distal end of a tension linkage 28 to selectively draw the cable tie strap 12 inward to tension the cable tie.

Figure 8:
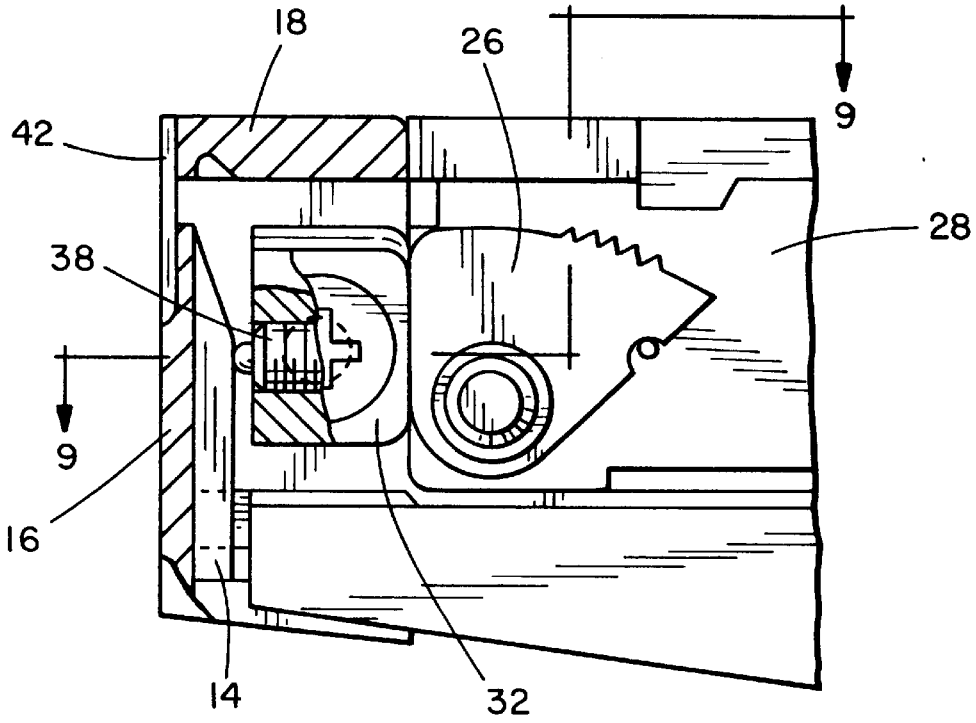
FIG. 8 is a fragmentary sectional view of an alternative embodiment of the tool of FIG. 4.
Figure 9:
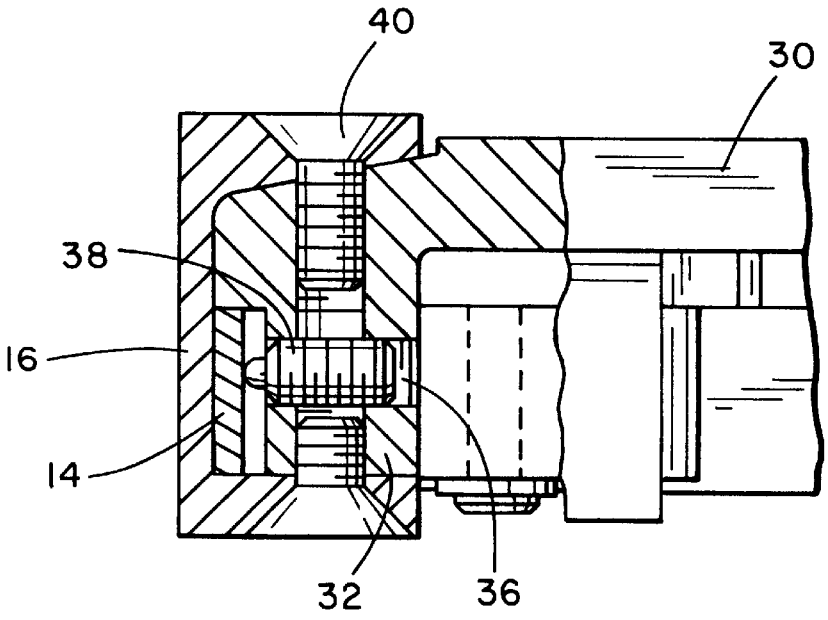
FIG. 9 is a fragmentary cross-sectional view of the alternative embodiment of the tool of FIG. 8 taken along line 9—9.

The tool housing 30 has a mounting boss 32 which projects from the interior surface thereof. The blade guard 16 is removably affixed thereto by a plurality of fasteners, in the instant case screws 40, and captures the blade 14 and the biasing means, a coil spring 34, therebetween. The biasing means is received within a spring pocket or bore 36 disposed within the boss 32. Thus, the coil spring 34 is positively retained to bias the blade 14 flush against an interior surface of the blade guard 16 during any vertical movement of the blade. Alternatively, a threaded bore 36 and a commonly available ball plunger 38 may be substituted for the spring pocket 36 and coil spring 34 in order to provide a friction-free biasing means, as seen in FIGS. 8 and 9.

Figure 6:
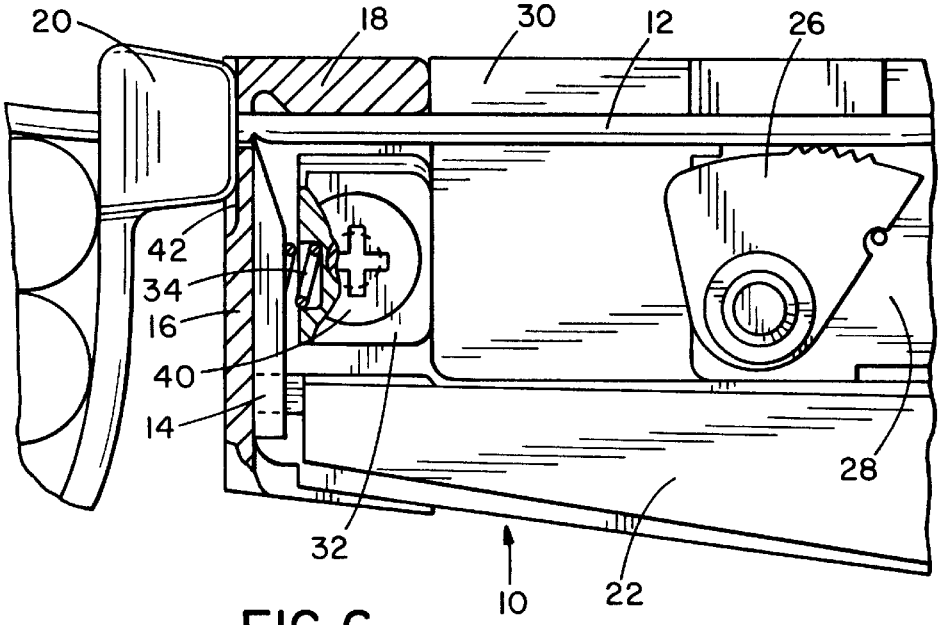
FIG. 6 is a fragmentary sectional view of the tool of FIG. 4 showing the severance blade biased against the blade guard as actuation begins thereof.
Figure 7:
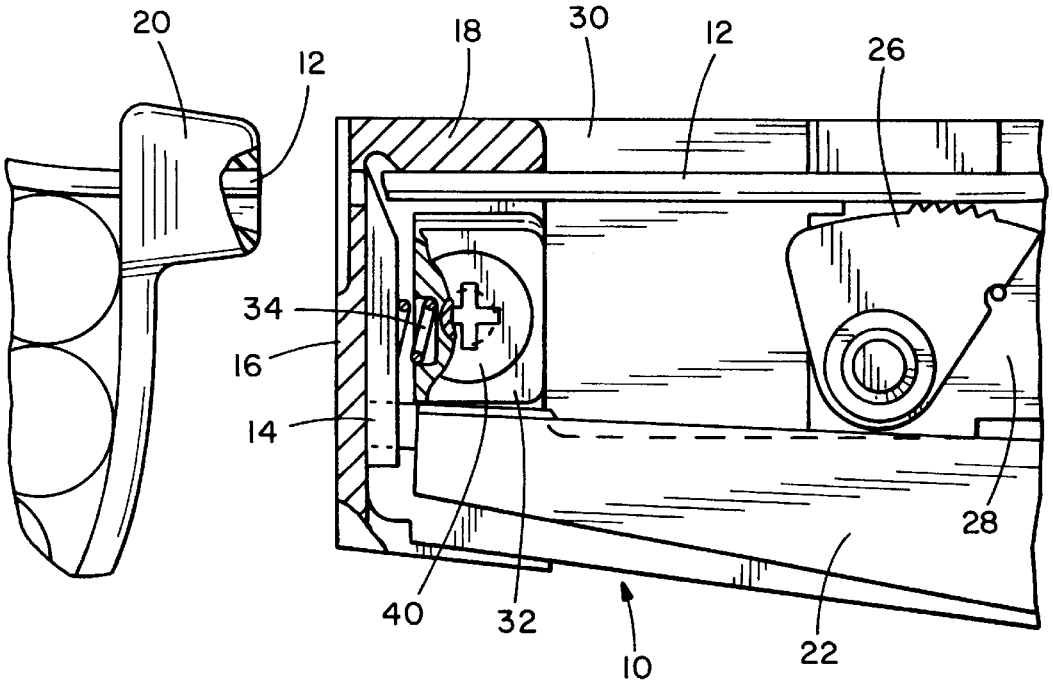
FIG. 7 is a fragmentary sectional view of the tool of FIG. 4 showing the flush cut-off height.

In operation, tool 10 withdraws strap 12, tensioning the cable tie (which in FIGS. 6 and 7 is only partially shown) until a predetermined tension is sensed by the tool mechanism which then actuates the linkage 22, pivoting the distal end of linkage 22 upwardly and driving blade 14 upwardly to sever strap 12. When at rest, as shown in FIG. 4 or during pivoting motion, as shown in FIGS. 6 and 7, blade 14 remains flush against the interior wall of the blade guard 16 to produce the absolute shortest cut-off height possible, as shown in FIG. 7. A flush cut-off height is commonly achieved from this arrangement. The strap is only slightly elastically stretched when tensioned and the barb or wedge disposed within the cable tie head withdraws a portion of the protruding portion of the strap back towards the cable tie head when the strap is severed thus further facilitating the flush-cut feature. Since the blade 14 remains flush against the blade guard 16, the result is a flush cut-off height.

Prior tools that do not bias the blade firmly against the blade guard 16 cannot repeatedly produce a flush cut-off height. The result is an inconsistent protruding cut-off height which leaves sharp edges exposed which may cut and injure or frustrate installation methods.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A cable tie application tool, comprising:

means for positioning a severance blade between a boss and a blade guard; and means for biasing the severance blade extending from a bore in the boss, wherein the biasing means forces the severance blade to remain in planar contact with the blade guard during vertical movement thereof; and wherein a cable tie strap may subsequently be severed flush with a cable tie head resulting in a snag-free installation.

2. A tool as set forth in claim 1, wherein the means for biasing comprises a coil spring.

3. A tool as set forth in claim 1, wherein the means for biasing comprises a ball plunger.

4. A tool as set forth in claim 3, wherein the bore comprises a threaded bore disposed within the boss.

5. A cable tie application tool, comprising:

means for positioning a cable tie strap above a severance blade which is vertically, slidably disposed between a boss and a blade guard; and means for biasing the severance blade partially disposed within a spring pocket in the boss;

wherein the biasing means extends from the boss to contact the severance blade such that the severance blade remains in flush contact with the blade guard during any movement thereof;

wherein the cable tie strap is subsequently severed flush with a cable tie head.

6. A tool as set forth in claim 5, wherein the means for biasing comprises a coil spring.

7. A tool as set forth in claim 5, wherein the means for biasing comprises a ball plunger.

8. A tool as set forth in claim 7, wherein the spring pocket comprises a threaded bore disposed within the boss.

9. A cable tie application tool, comprising:

a housing having a boss disposed at a forward end thereof;

a blade guard removably attached to the housing and boss such that a severance blade is disposed therebetween; and means for biasing disposed partially within the boss and extending from a bore in the boss to contact the severance blade, wherein the severance blade is forced flush against an interior surface of the blade guard throughout the entire travel thereof, and wherein a cable tie strap is cut-off flush with a cable tie head.

10. A tool as set forth in claim 9, wherein the means for biasing comprises a coil spring.

11. A tool as set forth in claim 9, wherein the means for biasing comprised a ball plunger.

12. A tool as set forth in claim 11, wherein the bore comprises a threaded bore disposed within the boss.

* * * * *